US006910787B2

(12) United States Patent
Thome et al.

(10) Patent No.: US 6,910,787 B2
(45) Date of Patent: Jun. 28, 2005

(54) LIGHT GUARD

(75) Inventors: Maxine C. Thome, St. Cloud, MN (US); Scott P. Thome, St. Cloud, MN (US)

(73) Assignee: Protective Devices, Inc., St. Cloud, MN (US)

( * ) Notice: Subject to any disclaimer, the term of this patent is extended or adjusted under 35 U.S.C. 154(b) by 24 days.

(21) Appl. No.: 09/929,827

(22) Filed: Aug. 14, 2001

(65) Prior Publication Data

US 2003/0035292 A1 Feb. 20, 2003

Related U.S. Application Data

(60) Provisional application No. 60/225,353, filed on Aug. 15, 2000.

(51) Int. Cl.[7] ..... F21V 15/00

(52) U.S. Cl. ..... 362/376; 362/147; 362/400

(58) Field of Search ..... 362/145, 147, 362/376, 362, 377, 396, 400, 296, 399; 52/28

(56) References Cited

U.S. PATENT DOCUMENTS

| | | | | |
|---|---|---|---|---|
| 2,259,237 A | * | 10/1941 | Baker et al. | 362/344 |
| 3,087,054 A | * | 4/1963 | Jones | 362/378 |
| 3,119,568 A | * | 1/1964 | Broder | 362/344 |
| 3,819,930 A | | 6/1974 | Lamont | |
| 3,826,912 A | | 7/1974 | Pomroy | |
| 3,935,560 A | * | 1/1976 | Dorn | 362/378 |
| 4,236,195 A | | 11/1980 | Kovacik | |
| 4,791,541 A | | 12/1988 | Simmons | |
| 5,537,304 A | * | 7/1996 | Klaus | 362/373 |
| 5,572,819 A | | 11/1996 | Topinka et al. | |

* cited by examiner

*Primary Examiner*—John Anthony Ward
(74) *Attorney, Agent, or Firm*—Dicke, Billig & Czaja PLLC

(57) ABSTRACT

A light guard of the present invention protects a light source mounted to a fixed surface. The light guard includes a base flange that is removably mountable to the fixed surface and a body portion that extends from the base flange for extending about and alongside the light source to prevent destruction of the light source.

16 Claims, 6 Drawing Sheets

LIGHT GUARD

CROSS REFERENCE TO RELATED APPLICATION

This Non-Provisional Utility Patent Application claims the benefit of the filing date of U.S. Provisional Application Ser. No. 60/225,353, filed on Aug. 15, 2000, entitled "LIGHT PROTECTION DEVICE".

THE FIELD OF THE INVENTION

The present invention relates to lighting accessories and in particular, a light source protector.

BACKGROUND OF THE INVENTION

Conventional incandescent light fixtures and bulbs have been installed in homes and businesses for many years. The conventional fixture includes a socket that protrudes from the ceiling or wall and that receives an ordinary incandescent light bulb. These fixtures are very inexpensive, and accordingly, are very popular. While finished levels of homes tend to have ornamental globes or covers that surround the light bulb and light fixture, in most basements and modest dwellings the incandescent light bulb remains uncovered.

With these conventional fixtures, the light bulb often extends from the fixture in an exposed, unprotected fashion. Accordingly, a ball or other sizable hard object, may contact the light bulb with sufficient force to break or shatter the light bulb. For example, the light bulb also can be broken by a moving ladder or moving furniture. More significantly, small children often break these light bulbs. A ball, or other play object, thrown by the children hits the light and shatters it, exposing the children to falling glass fragments. This event is very dangerous situation for the persons (children) near the breaking light bulb.

Despite the risk, a large number of these light bulbs remain unprotected either due to cost or inconvenience. For example, some conventional models of light protective devices include protective wire cages for protecting the light bulb, but also require the installation of a new electrical box and base fixture. These types of light protectors are quite expensive and require a substantial amount of work to install. In addition, these light protectors also absorb a fair amount of light, which would have the effect of dimming the room, which is highly undesirable. Finally, these conventional light protective devices are also aesthetically displeasing.

Accordingly, conventional light protective devices for general use in protecting exposed incandescent light bulbs are largely unavailable and/or are quite expensive and awkward to use.

SUMMARY OF THE INVENTION

A light guard of the present invention protects a light source mounted to a fixed surface. The light guard includes a base flange that is removably mountable relative to the fixed surface and a body portion that extends outward generally perpendicularly from the base flange for extending about and alongside the light source to prevent destruction of the light source. The light guard is separable into two halves to facilitate easy mounting relative to the mounting surface. Each guard half includes a base flange portion and a body portion. Finally, the body includes a means for releasably securing the two guard halves together in the mounted position.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

A light guard of the present invention protects incandescent light bulbs by permitting convenient retrofitting of the light guard to existing or new incandescent light fixtures. The light guard protects the light bulbs and people working or playing near the light bulbs, all at very little expense and with minimal installation time and effort. Finally, existing light fixtures can be used without additional parts or replacement fixtures.

To use the light guard of the present invention, an existing incandescent light fixture is first separated from its mounting surface, such as a wall, ceiling, or electrical box. Next, a base of the light guard is slipped between the light fixture and the mounting surface. The light guard includes two halves, so each half is separately fit about the light fixture from opposite sides of the fixture. As the two halves of the light guard are brought together, a base of the light guard is sandwiched between the light fixture and the mounting surface, and a body of the light guard is brought alongside but spaced from the light bulb. In a final step, the two halves of the light guard are releasably secured together by reciprocal snap fit and/or slidably engageable securing members arranged on each guard half. Upon releasably securing the two halves together, the light guard is then secured between the mounting surface and the light fixture using fasteners. Accordingly, this quick installation procedure yields a singular body light guard that is robustly secured relative to the light fixture and the mounting surface so that a body of the light guard remains secured alongside but spaced about the light bulb to protect the light bulb.

Figure 1:
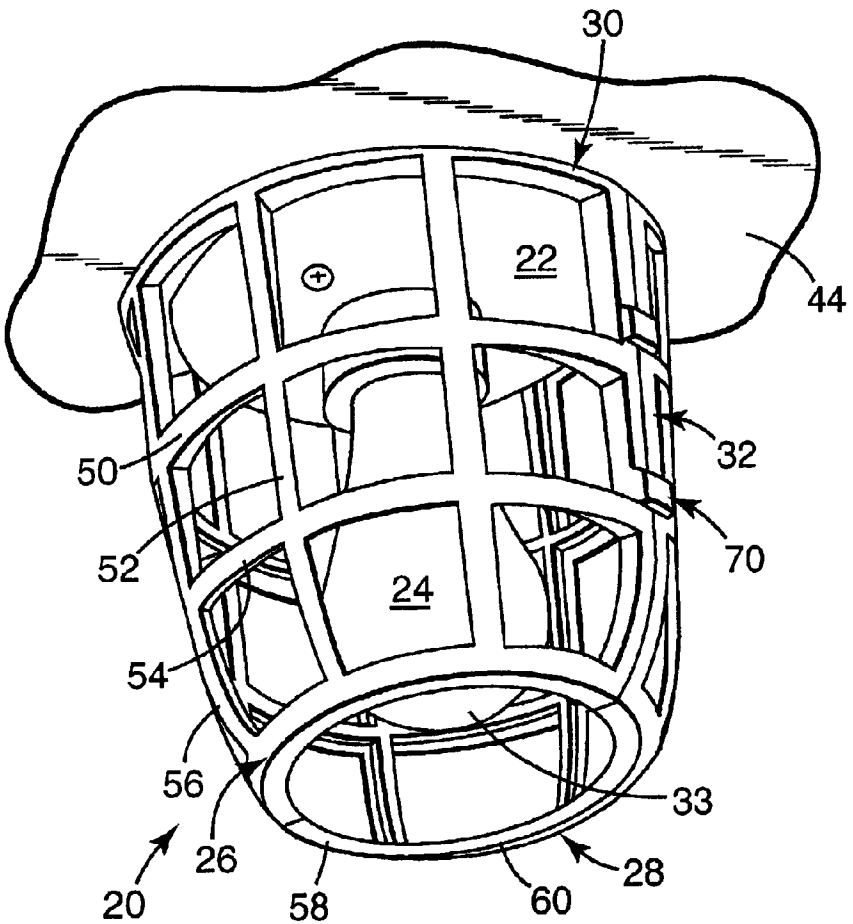
FIG. 1 is a perspective view of one exemplary embodiment of a light guard of the present invention.

As shown in FIG. 1, one exemplary embodiment of a light guard of the present invention is shown generally at 20. Light guard 20 is mounted about an incandescent light fixture 22 with light bulb 24. Light bulb 24 preferably comprises an incandescent light source, although optionally includes any light source, such as a compact fluorescent light source, or alternative light source.

Light guard 20 includes half 26 and half 28. Together, both guard halves 26,28 define base flange 30 and body 32. Body 32 extends from base flange 30 and is generally transverse to base flange 30 with a majority of body 32 configured to extend generally parallel to a longitudinal axis of light bulb 24 so that body 32 extends alongside light bulb 24 in a spaced relationship. Body 32 preferably has a length sufficient to extend beyond end 33 of light bulb 24.

Body 32 generally defines a generally cylindrical cage or latticework 50 including generally straight longitudinal members 52 and generally curved transverse members 54. However, body 32 optionally defines a generally tubular shape having other cross sectional shapes such as hexagons, pentagons, octagons, etc. Moreover, transverse members 54 are preferably generally perpendicular to longitudinal members 52 but can optionally be fixed at other angles (e.g, 30°, 45°) relative to longitudinal members 52, and even longitudinal members 52 can extend from base flange 30 at angles other than a strictly 90° angle. In short, body 32 defines a number of support members arranged together as a group to extend generally perpendicular from base flange 30 to protect light bulb 24 while letting light shine through body 32.

For the embodiment shown in FIG. 1, longitudinal members 52 include a relatively short curved section 56 adjacent outer end 58 of guard body 32 in a position to maintain a generally uniform spaced relationship of body 32 relative to light bulb 24 at end 33 of light bulb 24. The spacing, between and orientation of, longitudinal members 52 and transverse members 54 defined by latticework 50 is selected to meet the divergent criteria of being small enough to prevent entry of a surface of an external object/force through light guard 20 to contact light bulb 24 yet being large enough to permit sufficient light from light bulb 24 to be dispersed through light guard 20 for illuminating the surrounding environment. Moreover, the thickness, number, and shape of both longitudinal members 52 and transverse members 54 are selected using this same divergent criteria, as well as having sufficient strength, toughness, hardness, and flexibility necessary for preventing crushing, fracturing or undue bending of light guard body 32 when an external force contacts light guard 20. Finally, any single material or combination of non-metal (resins, polymer materials) and metal materials known to those skilled in the art can be selected to meet these criteria. For example, a metal material such as wire optionally is used to define latticework 50 wherein the wire is welded or otherwise formed into body 32, and optionally dipped in a polymer material such as urethane.

As further shown in FIG. 1, outer end 58 of body 32 includes an outermost transverse member 54 that defines a hole 60 for manual access to change light bulb 24 and to permit dispersion of light downward. However, hole 60 is sufficiently small to prevent penetration of most airborne ball-like objects into and past light guard 20. Alternatively, outer end 58 optionally is extended so that guard halves 26,28 will be joined together at outer end 58 without hole 60 to prevent access to light bulb 24.

Finally, light guard body 32 further includes releasable securing means 70 for releasably securing first guard half 26 relative to second guard half 28. As shown in FIG. 1, removable securing means 70 includes clasps 72 and pins 74. Releasable securing means 70 is further illustrated and described in greater detail in association with FIGS. 4–7. In addition, securing means 70 optionally is not releasable so that once guard halves 26 and 28 are secured together, they cannot be separated without intentionally damaging securing means 70 or otherwise materially altering light guard 20.

Figure 2:
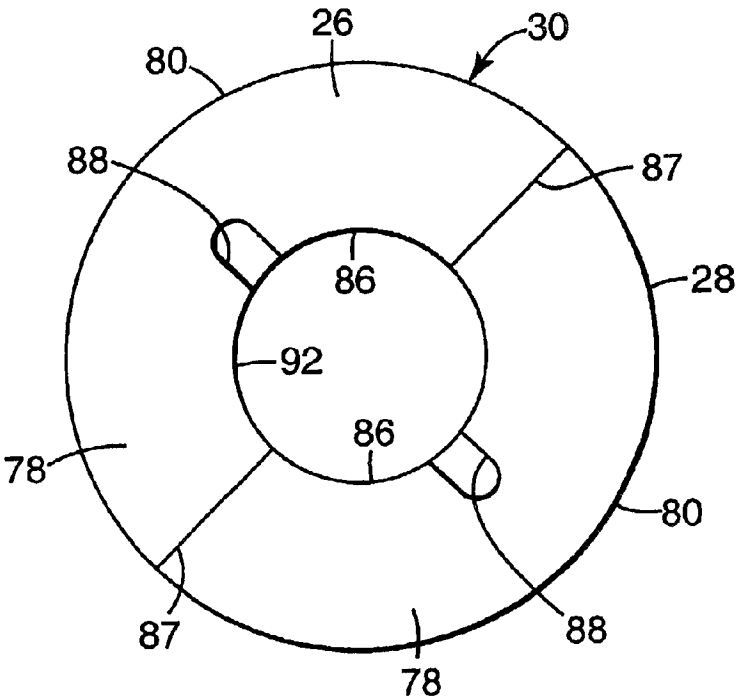
FIG. 2 is a plan end view of one exemplary embodiment of a light guard of the present invention.

As shown in FIG. 2, base flange 30 of light guard 20 is defined by both guard halves (26,28) including a generally semi-annular shaped flange portion 78 having outer circular edge 80, inner circular edge 86, and side edges 87 as well as slots 88 which extend outwardly from inner edge 86 at diametrically opposed positions. Slots 88 preferably are disposed at a right angle relative to side edges 87. When two guard halves 26 and 28 are joined together as shown in FIG. 2, side edges 87 of base flange 30 of guard half 26 abut side edges 87 of base flange 30 of guard half 28. Outer edge 80 of base flange 30 preferably defines a perimeter having an outer diameter that is generally greater than an outer diameter of a base of conventional fixture 22. Inner edge 86 of base flange 30 defines hole 92 having a diameter that is large enough to permit wires and other supporting electrical equipment to pass through the hole.

In use, fixture 22 is fastened against a mounting surface 44 (ceiling, wall, or mobile structure with a mountable surface) as shown in FIG. 1, with base flange 30 of light guard 20 sandwiched between fixture 22 and mounting surface 44 to secure light guard 20 against mounting surface 44, and to secure light guard 20 relative to fixture 22 and light bulb 24. Fasteners 25 extend through fixture 22 and slots 88 of base flange 30 into mounting surface 44. The surface area of base flange 30 is sufficiently large to insure a robust mounting of light guard 20 relative to fixture 22, rendering light guard 20 relatively impervious to being dislodged by external forces contacting light guard from virtually all directions (axial, transverse, angled). In particular, since the large surface area of base flange 30 is aligned generally parallel with mounting surface 44 and with fixture 22, light guard 20 is extremely stable. Flange 30 has a thickness that is small enough to permit sandwich-type mounting yet great enough to be relatively fracture proof. Slots 88 further insure secure mounting of base flange 30 of light guard 20 by preventing rotational and transverse movement of light guard 20 once fasteners 25 extend through slots 38.

Figure 3:
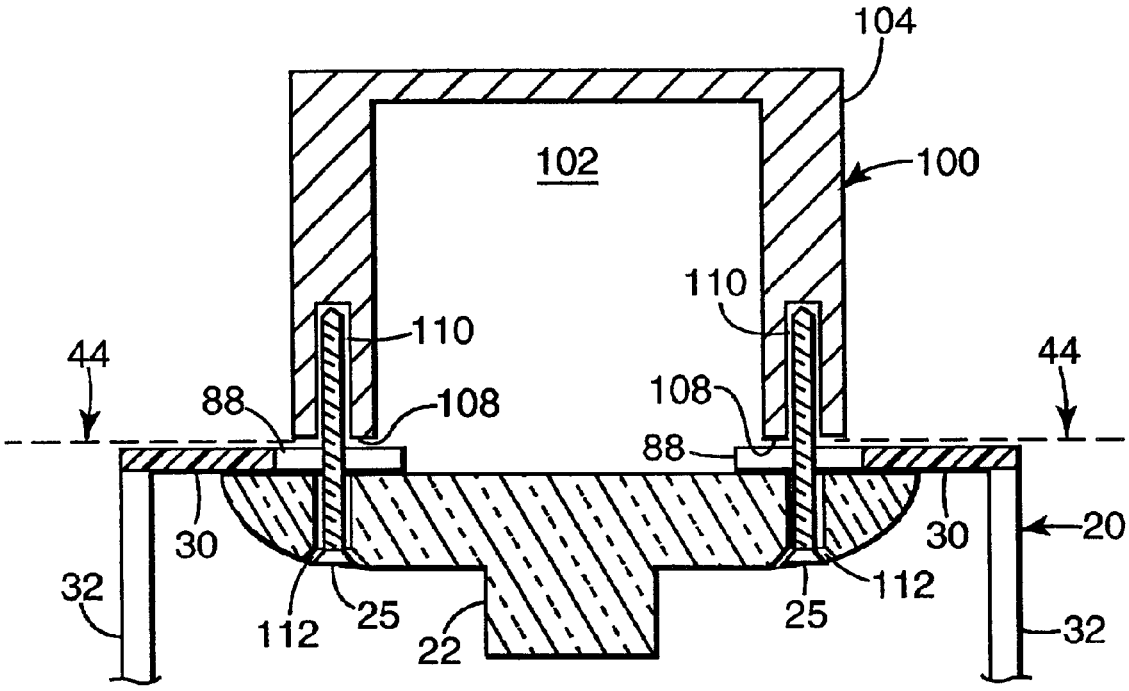
FIG. 3 is a sectional view of FIG. 1 as taken along lines 3—3.

FIG. 3 is a cross sectional view of FIG. 1. As shown in FIG. 3, mounting surface 44 optionally includes a conventional electrical junction box 100 of the type ordinarily employed to mechanically and electrically support an incandescent light bulb fixture. Electrical junction box 100 includes recess 102 for housing electrical wires (not shown) and outer wall 104 (and optionally inner walls) having an edge 106 that generally forms one or more contact portions 108 that act as mounting surface 44 against base flange 30. Contact portions 108 generally define a single plane, although the contact portions optionally are formed to define more than one plane, wherein base flange 30 is optionally reciprocally shaped in more than one plane to contact select contact portions 108 on box 100 (or other mounting surface 44). Box 100 also commonly includes holes 110 for receiving fasteners 25 that secure base flange 30 of light guard 20 against box 100.

When light guard 20 is installed, as shown in FIG. 3, base flange 30 of light guard 20 is positioned between fixture 22 and contact portions 108 of box 100 (and/or mounting surface 44). Fasteners 25 extend through holes 112 in fixture 22, through base flange 30 of light guard 20 (via slots 88), into holes 110 of electrical box wall 104. Fasteners 25 hold base flange 30 in a sandwiched position between fixture 22 and electrical box 100 (and/or mounting surface 44). While mounting surface 44 can be limited only to contact portions 108 of electrical box 100, mounting surface 44 also optionally further comprises a flat sheet of material such as gypsum board.

Figure 4:
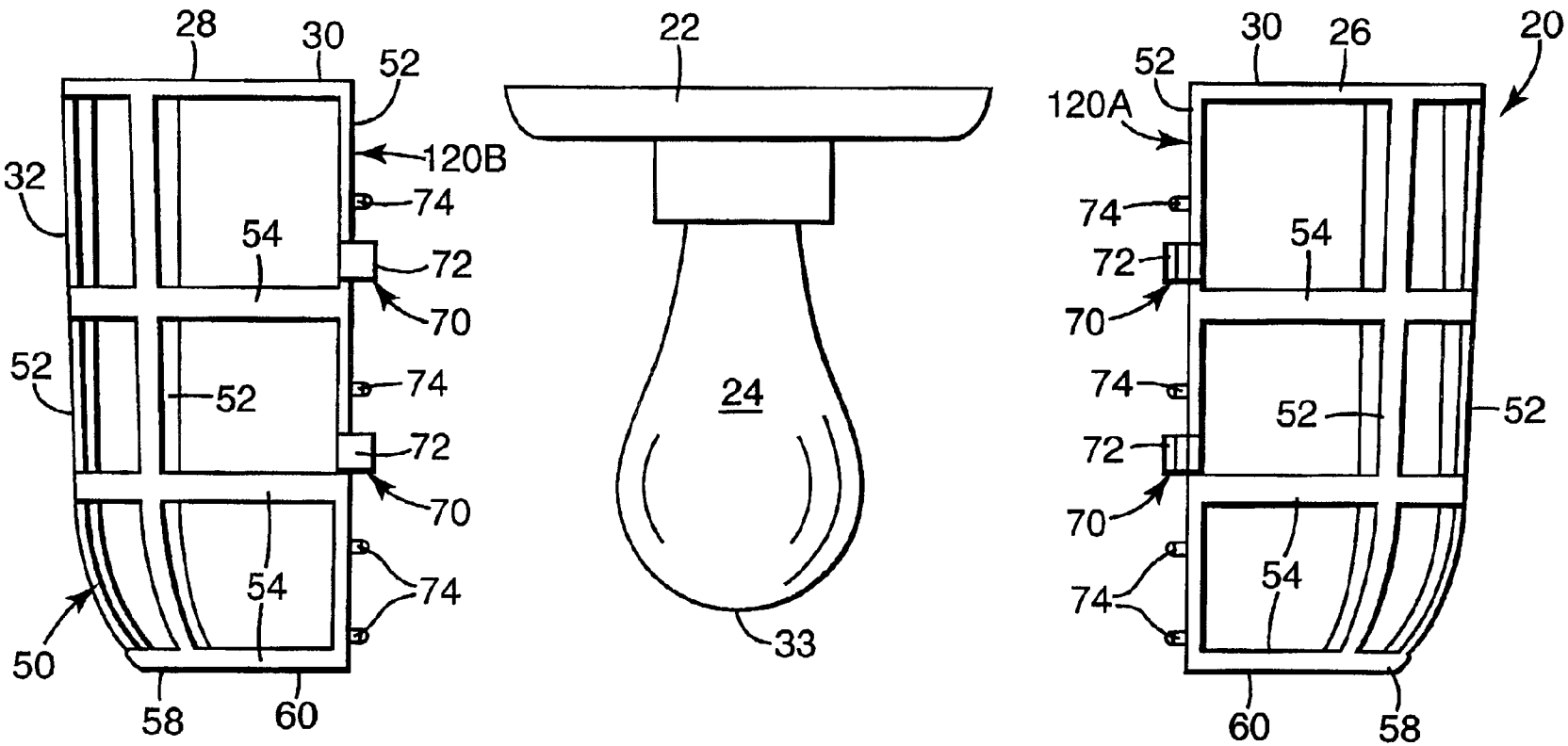
FIG. 4 is a partial side view of two halves of one exemplary embodiment of a light guard of the present invention.
Figure 5:
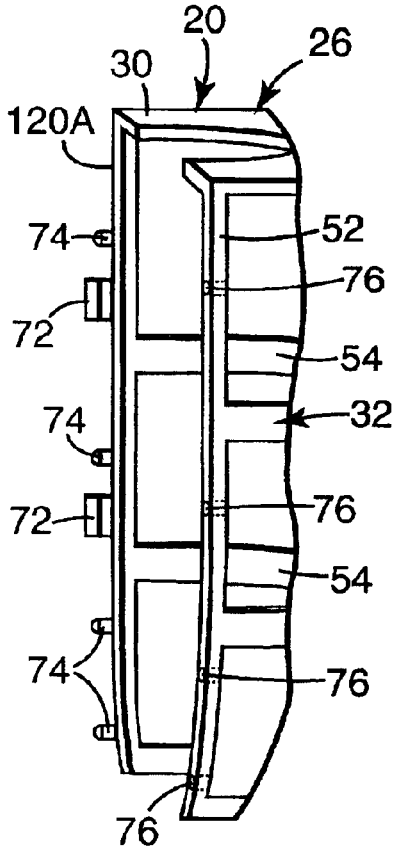
FIG. 5 is a partial perspective view of one guard half of one exemplary embodiment of a light guard of the present invention.
Figure 6:
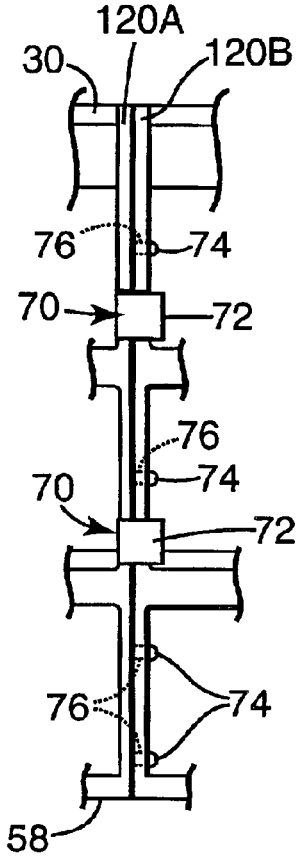
FIG. 6 is partial plan view of two guard halves joined together as part of one exemplary embodiment of the present invention.

To further illustrate the construction of light guard 20 and it method of use, FIG. 4 illustrates two guard halves 26, 28 prior to their assembly together to form the singular light guard 20 shown in FIG. 1. As shown in FIG. 4, guard half 26 and guard half 28 each include side longitudinal members 120A, 120B on which multiple removable securing means 70 are disposed. Side member 120A includes both clasps 72 and pins 74 wherein two clasps are disposed on side member 120A at generally equidistant positions relative to one another and relative to base flange 30 and outer end 58. Pins 74 are also positioned on side member 120A relatively equidistant to each other with two pins 74 being directly adjacent each other near outer end 58 of guard 20 while only one pin 74 is disposed between clasps 72 and between base flange 30 and its nearest clasp 72. Pins 74 will be received on side member 120B by a set of reciprocal holes 76 in the opposite guard half 28, which are shown in FIGS. 5–6. Holes 76 on side member 120B have the same general spacing and position as pins 74 on side member 120A.

More or less than the number of clasps 72 and/or pins 74 (and holes 76) shown can be used, as well as their position and shape varied so long as sufficient securing means are available to maintain guard halves 26 and 28 in a selectively fixed position relative to one another when releasably secured with means 70.

Moreover, releasable securing means 70, such as clasps 72, pins 74 and holes 76, optionally can include other shapes and sizes (wires, snaps, pressure sensitive adhesives, hook and loop fasteners, press fits, rods, glues, screws etc.) so long as the alternative structure achieves selective releasable securing of one longitudinal member 52 of one guard half (26,28) relative to one longitudinal member 52 of another guard half (26,28) to form of single light guard 20.

As shown in FIG. 6, when guard half 26 is joined to guard half 28, then two opposed side members 120A, 120B define a single longitudinal member 54 of body 32 with pins 74 releasably press fit into holes 76 and clasps 72 slidably engaged onto an opposed, abutting longitudinal side member 120A, 120B.

Figure 7:
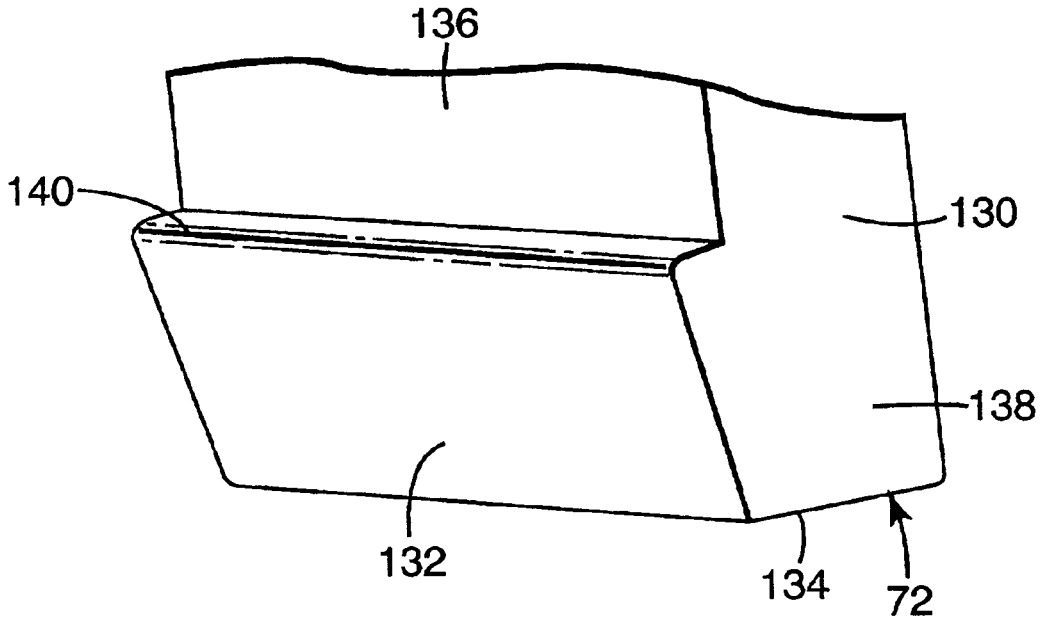
FIG. 7 is a perspective view of a releasable securing means of one exemplary embodiment of the light guard of the present invention.

Clasps 72 of releasable securing means 70 are further illustrated in FIG. 7. Each clasp 72 includes a body 130 with beveled protrusion 132 formed near outer end 134 and on inner side 136 of clasp 72. Outer side 138 of clasp 72 preferably includes no protrusions. Recessed edge 140 of protrusion 132 is spaced from longitudinal member 52 (e.g. side member 120A) of guard half 26 sufficiently to permit beveled protrusion 132 to slide past a longitudinal member 52 (side member 120B) from an opposed guard half 28 until recessed edge 140 seats behind the side member 120B of the opposed guard half. Clasp 72 is sufficiently resilient to permit slight bending of clasp 72 relative to longitudinal member 52 to permit sliding action of clasp 72 relative to another longitudinal member 52 about which clasp 72 will become lodged.

In use, a homeowner or other user can add light guard 20 to protect a light bulb mounted in a conventional incandescent light fixture in several simple steps. First, fasteners 25 holding fixture 22 against mounting surface 44 (such as box 100 and surrounding wall surface) as shown in FIGS. 1 and 3 are partially withdrawn to slightly separate fixture 22 from mounting surface 44 (e.g. electrical junction box 100 and/or surrounding wall surface). Base flange 30 of guard 20 is sandwiched between mounting surface 44 and fixture 22, with each guard half 26 and 28 being slid into place on opposite sides of fixture 22, aligning slots 38 with fasteners 25. Guard halves 26 and 28 are advanced until side edges 87 of base flange 30 and edges 120A, 120B of body 32 of the respective halves abut each other and until securing means 70 is activated to hold halves 26 and 28 securely against each other to form singular, closed position light guard 20. In this position, fixture 22 will hold light guard 20 temporarily in place between mounting surface 44 (e.g. electrical box 100) and fixture 22. Fasteners 25 are then advanced back into fixture 22 to securely force fixture 22 and base flange 30 of light guard 20 against mounting surface 44 (e.g. electrical box 100) into a fixed position as shown in FIG. 1.

Accordingly, with these simple steps, an ordinary incandescent light fixture is retrofitted with an easy-to-install, yet robust, light guard 20 of the present invention. The existing electrical box 100 (or other mounting surface 44) is used and need not be replaced. Moreover, even fixture 22 need not be completely removed to complete the installation. Rather, fasteners 25 only need be slightly loosened to allow slidable insertion of light guard 20 into position about fixture 22, and then retightened.

Figure 8:
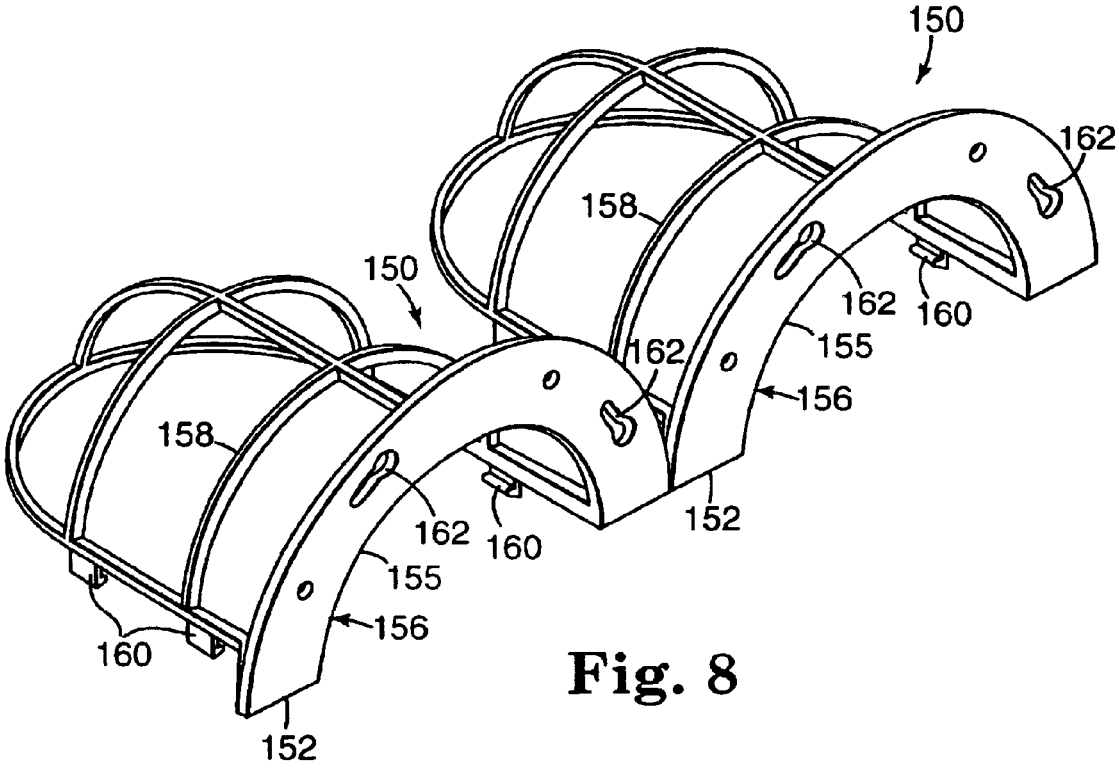
FIG. 8 is a perspective view of an alternate embodiment of a light guard of the present invention.

FIG. 8 illustrates an alternative embodiment light guard 150 in which two guard halves 152 (only one of which is shown for illustrative purposes) have substantially the same attributes and features as light guard 20 except having a narrower base flange 156 that is designed for direct mounting to mounting surface independent of light fixture 22. Halves 152 are secured together by releasable securing means 160, which is generally the same as clasp 72 and/or the complete releasable securing means 70 described and illustrated in association with FIGS. 1–7. However, light guard 150 optionally is defined by a single, unitary frame instead of two separate frames halves (e.g., like frame half 152) with the single frame having a shape, size and configuration equivalent to two halves joined together and being substantially similar to the frame half shown in FIG. 8.

Like light guard 20, light guard 150 includes base flange 156 and body 158 where base flange 156 is removably securable against mounting surface 44 for mounting light guard 150 relative to the mounting surface and relative to a light bulb about which light guard 150 resides. Base flange 156 is sized and configured with a central hole 155 having a diameter greater than a diameter of light fixture 22 so that the base flange 156 fits around the outside perimeter of the light fixture 22 instead of between the light fixture 22 and mounting surface 44. Mounting surface 44 (FIG. 1) preferably comprises a flat panel material such as gypsum board (sheetrock) or other ceiling or wall material (e.g., wood, plaster, etc.). Base flange 156 includes mounting holes 162 configured for receiving fasteners for securely fixing base flange against mounting surface 44. The fasteners optionally are anchored into mounting surface 44 with an anchor to improve their mechanical strength, thus more securely anchoring light guard 150 against mounting surface 44. With this embodiment, the fixture need not be loosened from mounting surface 44 to install light guard 150. Rather, light guard 150 is simply slipped over light fixture 22 and bulb 24, and then base flange 156 is secured against mounting surface 44 with fasteners 25 (or with an adhesive or other means).

Figure 9:
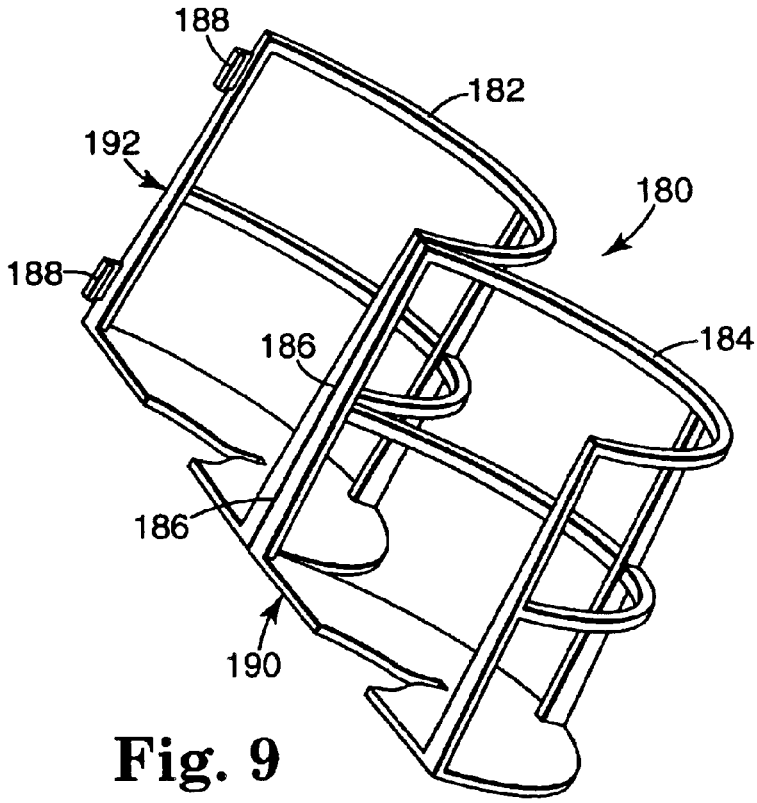
FIG. 9 is a perspective view of an alternate embodiment of a light guard of the present invention.

FIG. 9 illustrates an alternative embodiment light guard 180 in which two guard halves 182,184 have substantially the same attributes and features as light guard 20 except being joined by a living hinge 186 of resilient material that permits guard half 182 to pivot relative to guard half 184 in a direction generally transverse to a longitudinal axis of a light bulb to be protected. Halves 182 and 184 are secured together by releasable securing means 188, which is generally the same as clasp 72 and/or the complete releasable securing means 70 described and illustrated in association with FIGS. 1–7. Living hinge 186 permits easy access to a light bulb while reducing the number of releasable securing means necessary to join halves 182 and 184. Like light guard 20, light guard 180 includes base flange 190 and body 192 where base flange 190 is removable securable between a light fixture (e.g, fixture 22) and mounting surface 44 (wall/ceiling/mobile fixture surface) for mounting light guard 180 relative to mounting surface 44 and relative to a light bulb about which light guard resides. Base flange 190 and body 192 carry substantially the same attributes and features as base flange 30 and body 32 of light guard 20 previously described in association with FIGS. 1–7.

Variations on the described light guards include using glue or adhesive to secure a light guard to fixture 22. In another aspect, body 52 of light guard 20 is extended to omit hole 60 and optionally define a pivoting bottom portion having an open position and a closed position. In the closed position, the bottom portion is releasably secured to the remainder of body 52 and protects light source 24. In the open position, the bottom portion is pivoted away from the remainder of body 52 to provide access to light source 24 for changing light source 24 within light guard of the present invention.

A light protector of the present invention carries numerous advantages. The light guard is easy to install, using existing light fixtures, with no electrical work required. The light guard is costs little yet mechanically protects the light bulb from reasonable mechanical forces such as those created by flying balls, moving ladders etc. The open framework design does not significantly reduce the light generated by the light bulb and allows for ease of changing the light bulb when required. Most importantly, people are protected from falling broken glass shattered from previously exposed and unprotected incandescent light bulbs.

Although specific embodiments have been illustrated and described herein for purposes of description of the preferred embodiment, it will be appreciated by those of ordinary skill in the art that a wide variety of alternate and/or equivalent implementations may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A light guard for guarding a light source extending from a light socket fixture mounted on a building mounting surface, the light guard comprising:

a frame including a first half, a second half, and means for removably securing the two frame halves relative to each other, each frame half including a base flange and a body, wherein the body defines latticework of support members and is configured and arranged to extend about the light source and generally parallel to a longitudinal axis of light source, and wherein the body extends directly from the edge of the base flange generally perpendicular relative to the base flange, and wherein the base flange is configured and arranged for disposition between, and in contact against, a light socket fixture and a building mounting surface.

2. The guard of claim 1 wherein the means for removably securing further comprises:

at least one projection disposed on a first edge of the first body half and a hole disposed on a first edge of the second body half wherein the projection is configured to slidably engage the hole; and at least one projection disposed on a second edge of the second body half and a hole disposed on a second edge of the first body half wherein the projection is configured to slidably engage the hole.

3. The guard of claim 2 wherein the means for removably securing further comprises:

at least one clasp disposed on the first edge of the first body half and configured for slidably engaging a portion of the first edge of the second body half; and at least one clasp disposed on the second edge of the second body half and configured for slidably engaging a portion of the second edge of the first body half.

4. The guard of claim 1 wherein the means for removably securing includes a first portion disposed on an edge of the first body half and a second portion disposed on an edge of the second body half wherein the first portion and the second portion comprise at least one or more of a clasp, a pin, a hole, a beveled protrusion, a projection, a hook and loop fastener, a mechanical fastener, and a clip.

5. The guard of claim 1 wherein the base flange of each frame half has a generally semi-annular shape and includes at least one slot extending radially outward from a generally circular shaped, inner edge of the base flange, the slot being disposed at generally right angle relative to a side edge of the base flange so that when respective side edges of the two frame halves are joined together the slot of the first body half and the slot of the second body half are aligned diametrically opposed to each other and aligned generally parallel to each other.

6. The guard of claim 1 wherein each body includes a bottom edge having a generally semi-circular shape so that when the two body halves are joined together, the bottom edge forms a generally circular access hole for accessing a light bulb enclosed by the light guard.

7. The guard of claim 1 wherein the base flange has a generally circular shape with a generally circular-shaped central hole.

8. A method of guarding a light source mounted in a light socket fixture comprising:

providing a frame having a first half, a second half, and means for releasably securing the two frame halves relative to each other, with each frame half including a base portion and a body portion with the body portion including a plurality of support members, and securing the base portion of the frame between a base of a light socket fixture and a building mounting surface, to be in contact with the building mounting surface, to cause the body portion of the frame, which extends generally perpendicularly relative to the base portion of the frame, to extend in a spaced relationship alongside and about the light source.

9. A method of guarding a light source mounted in a light socket fixture comprising:

removably securing a first base portion of a frame between the light socket fixture and a fixed mounting surface, and to be in contact against both the light fixture and the fixed mounting surface, to cause a first body portion of the frame, which extends generally perpendicularly relative to the base portion of the frame, to extend in a spaced relationship generally parallel to and about the light source;

removably securing a second base portion of the frame between the light socket fixture and the fixed mounting surface, to be in contact against both the light fixture and the fixed mounting surface, to cause a second body portion of the frame, which extends generally perpendicularly relative to the second base portion of the frame, to extend in a spaced relationship generally parallel to and about the light source; and removably securing the first body portion relative to the second body portion to protectively enclose the light source within the frame.

10. A method of installing a light guard, the method comprising:

providing a light fixture in a secured position against a fixed mounting surface with the fixed mounting surface including at least one of a wall surface, a ceiling surface, and a electrical junction box;

providing a light guard having first a half, a second half, and means for releasably securing the first half relative to the second half with each frame half including a base flange and a body;

sandwiching the base flange of the light guard halves between the light fixture and the fixed mounting surface to position the body of the light guard halves, that extends generally perpendicular outward from the base flange, to extend a spaced relationship about a light source mounted in the light fixture; and releasably securing the first guard half to the second guard half.

11. The method of claim 10 wherein sandwiching the base flange further comprises:

loosening the light fixture relative to the fixed mounting surface;

inserting the base flange of the light guard halves between the light fixture and the fixed mounting surface; and tightening the light fixture against the base flange of the light guard and the fixed mounting surface.

12. A light guard comprising:

a base portion having a generally circular shape that defines a central hole and including a plurality of slots configured and positioned to receive a fastener in each slot, with the fastener being independent from the light guard, and to direct the fastener through a light fixture and the slot for securing the light fixture against the base portion; and a body portion extending generally perpendicular outward from the base portion in a generally cylindrical shape and defining a latticework of support members, wherein the base portion and the body portion are comprised of two halves configured substantially the same as each other and including a releasably securing mechanism mountable on at least one of the two halves for releasably securing the two halves together.

13. A light guard comprising:

a base portion having a generally annular shape that defines a central hole with the central hole being sized and configured for securing the base portion directly against a building mounting surface independent of a base of a light fixture with a diameter of the central hole being greater than a diameter of the base of the light fixture; and a body portion extending generally perpendicular outward from the base in a generally cylindrical shape and defining a latticework of support members.

14. The light guard of claim 13 wherein the base portion comprises at least one of the following fastening mechanisms for securing the base portion against the mounting surface, including:

a plurality of holes, a hook and loop fastener, a pressure sensitive adhesive, a glue and a wall anchor.

15. A light guard comprising:

a base portion having a generally annular shape that defines a central hole and an outer generally circular edge, with the base portion configured and arranged for disposition between, and in contact against, a light socket fixture and a building mounting surface;

a body portion having a generally cylindrical shape and defining a latticework of support members, and extending generally perpendicular outward from the base portion directly from the outer generally circular edge; and a living hinge connecting a first half and a second half of the light guard to permit the first half and the second half to be moved between an open position for access to an interior of the body portion and a closed position for preventing access to an interior of the body portion.

16. The method of claim 11, wherein providing a light fixture in a secured position comprises:

providing a pair of holes that extend through the light fixture;

extending a fastener through each hole of the light fixture and securing each fastener into the fixed mounting surface to secure the light fixture against the fixed mounting surface.

* * * * *